US005105078A

United States Patent [19]

Nochise et al.

[11] Patent Number: 5,105,078

[45] Date of Patent: Apr. 14, 1992

[54] APPARATUS AND METHOD FOR DETECTING OVERLAPPED PAPER SHEET FEED

[75] Inventors: Minoru Nochise, Yamato; Kazushi Yamauchi, Fujisawa, both of Japan

[73] Assignee: International Business Machines Corp., Armonk, N.Y.

[21] Appl. No.: 655,523

[22] Filed: Feb. 14, 1991

[30] Foreign Application Priority Data

Mar. 9, 1990 [JP] Japan ..... 2-56823

[51] Int. Cl.[5] ..... B65H 7/12; B65H 7/14

[52] U.S. Cl. ..... 250/223 R; 271/263; 356/434

[58] Field of Search ..... 250/223 R, 571; 271/262, 263; 356/434

[56] References Cited

U.S. PATENT DOCUMENTS 4,652,742 3/1987 Waver et al. ..... 250/223 R

*Primary Examiner*—Carolyn E. Fields

*Attorney, Agent, or Firm*—Laurence R. Letson

[57] ABSTRACT

An apparatus for detecting overlapped paper sheet feed in a paper sheet feed path. The apparatus includes a photosensor and a load resistor located in the paper sheet feed path for detecting a voltage representing a light transmittivity of paper sheet(s) fed through the paper sheet feed path. The apparatus also includes a resistor control for changing the resistance value of the load resistor between a first resistance which generates a predetermined detected voltage at the feed of a single paper sheet of the highest light transmittivity and a second resistance generating the predetermined detected voltage at a feed of a single paper sheet of the lowest light transmittivity and for comparing a detected voltage of a first paper sheet with the predetermined detected voltage to generate a first signal indicating that the detected voltage is equal to the predetermined detected voltage and a second signal indicating that the detected voltage is not equal to the predetermined detected voltage and for fixing the resistance value of the load resistor in response to the first signal and generating an error signal representing the overlapped paper sheet feed in response to the second signal. The apparatus also includes means for comparing a detected voltage of a second paper sheet with a first threshold voltage which is established separately from the predetermined detected voltage to discriminate a single paper sheet feed and an overlapped paper sheet feed in order to generate an error signal when the detected voltage of the second paper sheet is a voltage indicating an overlapped paper sheet feed.

7 Claims, 8 Drawing Sheets

A1 : 45Kg PAPER x 1
A2 : 45Kg PAPER x 2
B1 : 75Kg PAPER x 1
B2 : 75Kg PAPER x 2
C1 : 135Kg PAPER x 1
C2 : 135Kg PAPER x 2

R11< R12< R13

APPARATUS AND METHOD FOR DETECTING OVERLAPPED PAPER SHEET FEED

BACKGROUND OF THE INVENTION

The invention relates to an apparatus and method for detecting overlapped paper sheet feed by discriminating a voltage detected by a photo sensor and a load resistor located in a paper sheet feed path, which represents a light transmittivity of paper sheet.

Various apparatuses have been developed which detect a misfeed of paper sheets in a paper feed path. "Misfeed of paper sheets" in the specification means that plural paper sheets are overlappingly supplied from a sheet stacker to the paper sheet feed path. A practical method for detecting the misfeed of paper sheets is to detect a thickness of paper sheet(s) supplied into the paper sheet feed path.

The thickness of a paper sheet has been measured by sensing a transmitted light through the paper sheet. Japanese Patent Application 61-189291 (Published Unexamined Patent Application 63-47244) disclosed two sets of paper sensors positioned at an exit of a paper stacker and an exit of a toner fixing station, respectively, of a copying machine. The paper sensor includes a light emitting diode (LED) and a photo sensor. The voltage applied to the LED is increased until the photo sensor detects the transmitted light through the paper sheet. When the photo sensor does not sense the transmitted light even when the voltage is increased to a maximum value, a control device judges that the thickness of the paper is too large for the copying machine. When the photo sensor senses the transmitted light and the voltage value is at a minimum value, the control device judges that the thickness of the paper is too small. When the voltage sensed by the photo sensor is in a nominal range, the voltage value sensed by the sensor at the exit of the paper stacker is stored and the voltage applied to the LED of each paper sensor is fixed. A voltage sensed by the photo sensor at the exit of the toner fixing station is compared to the stored value to determine the occurrence of a paper jam between the two sets of paper sensors. The Patent Application 61-189291 does not intend to sense the overlapped paper sheet feed of various thickness.

Japanese Patent Application 61-72167 (Published Unexamined Patent Application 62-229389) discloses a sensor for sensing a thickness of a bill, wherein various different threshold values for the various thickness of the bill are used, and one of the threshold values is used depending upon the results of the detecting operations. The Patent Application 61-72167 requires switching of the threshold values depending upon the results of detection.

SUMMARY OF THE INVENTION

The method, in accordance with the present invention, for detecting the misfeed of paper sheets or the overlapped paper sheet feed by discriminating a voltage detected by a photo sensor located in a paper sheet feed path, which represents a light transmittivity of paper sheet(s) is characterized by the steps of:

feeding a first paper sheet through the paper sheet feed path;

changing a sensitivity of the photo sensor between a first value generating a predetermined detected voltage at a feed of a single paper sheet of the highest light transmittivity and a second value generating said predetermined detected voltage at a feed of a single paper sheet of the lowest light transmittivity to determine whether the detected voltage becomes equal to the predetermined detected voltage;

fixing the sensitivity of the photo sensor to a value at which the detected voltage becomes equal to the predetermined detected voltage;

generating an error signal indicating the overlapped paper sheet feed when the detected voltage does not become equal to the predetermined detected voltage; and comparing the detected voltage of succeeding paper sheet with a first threshold voltage which is established separately from the predetermined detected voltage for discriminating the single paper sheet feed and the overlapped paper sheet feed so as to generate an error signal when the detected voltage of the succeeding paper sheet is a voltage indicating the overlapped paper sheet feed.

In the method for detecting overlapped paper sheet feed according to one form of the present invention, the photo sensor includes a photo transistor and a load resistor. The sensitivity of the photo sensor is changed by changing a resistance value of the load resistor between a first resistance value generating the predetermined detected voltage at a feed of a single paper sheet of the highest light transmittivity and a second resistance value generating the predetermined detected voltage at a feed of a single paper sheet of the lowest light transmittivity and the resistance value of the load resistor is fixed to a resistance value at which the detected voltage becomes equal to the predetermined detected voltage.

The method in accordance with another form of the present invention includes steps of:

comparing a detected voltage of succeeding paper sheet(s) with a second threshold voltage which is established between the predetermined detected voltage and a voltage generated when the single paper sheet of the highest light transmittivity is fed through the paper sheet feed path in the case that the resistance value of the load resistor is not equal to the first resistance value within the range defined by the first resistance value and the second resistance value; and generating an error signal indicating the overlapped paper sheet feed in a previous paper sheet feed when the detected voltage is a voltage representing the single paper sheet feed.

In the foregoing method in accordance with the present invention, the step of changing the resistance value of the load resistor is initiated in response to one of a print start signal, a signal indicating that the number of paper sheets fed into the paper sheet path has reached a predetermined number, a switch signal for switching between the paper sheet feed of the highest light transmittivity and the paper sheet feed of the lowest light transmittivity, and the error signal.

An apparatus, in accordance with the present invention, for detecting the overlapped paper sheet feed in the paper sheet feed path comprises:

a photo sensor and a load resistor located in the paper sheet feed path for detecting a voltage representing a light transmittivity of paper sheet(s) fed through the paper sheet feed path;

a resistor control means for changing a resistance value of said load resistor between a first resistance value generating a predetermined detected voltage at a feed of single paper sheet of the highest light transmittivity and a second resistance value generating said predetermined detected voltage at a feed of single paper sheet of the lowest light transmittivity to compare a detected voltage of first paper sheet with the predetermined detected voltage so as to generate a first signal indicating that the detected voltage becomes equal to the predetermined detected voltage and a second signal indicating that the detected voltage does not become equal to the predetermined detected voltage, fixing the resistance value of the load resistor in response to the first signal, and generating an error signal representing the overlapped paper sheet feed in the first paper sheet feed in response to the second signal; and first compare means for comparing a detected voltage of a second paper sheet with a first threshold voltage which is established separately from the predetermined detected voltage to discriminate the single paper sheet feed and the overlapped paper sheet feed so as to generate an error signal when the detected voltage of the second paper sheet is a voltage indicating the overlapped paper sheet feed.

The apparatus in accordance with the present invention includes second compare means for comparing a detected voltage with a second threshold voltage which is established between the predetermined detected voltage and a voltage generated when the single paper sheet of the highest light transmittivity is fed through the paper sheet feed path in the case that the resistance value of the load resistor is not equal to the first resistance value within the range defined by the first resistance value and the second resistance value, and generating an error signal indicating the overlapped paper sheet feed in the previous paper sheet feed when the detected voltage is a voltage representing the single paper sheet feed.

A resistor control means in accordance with the present invention includes:

a counter connected to the load resistor for controlling the resistance value of the load resistor; and means for incrementing the counter in response to a signal indicating an existence of the paper sheet in the paper sheet feed path, and stopping the increment of the counter in response to the first signal.

BRIEF DESCRIPTION OF THE DRAWINGS

The FIGS. 1A and 1B show the light emitting diode, the photo transistor and the load resistor located in the paper sheet feed path.

The FIGS. 2 and 3 show the curves indicating the relationship between the resistance value r between the collector and the emitter of the photo transistor and the detected voltage $V_0$.

The FIGS. 4, 5, 6 and 7 show the way to establish the predetermined voltage $V_{int}$, and the first and second threshold voltages $Vth_1$ and $Vth_2$, in accordance with the present inventions.

Figure 8:
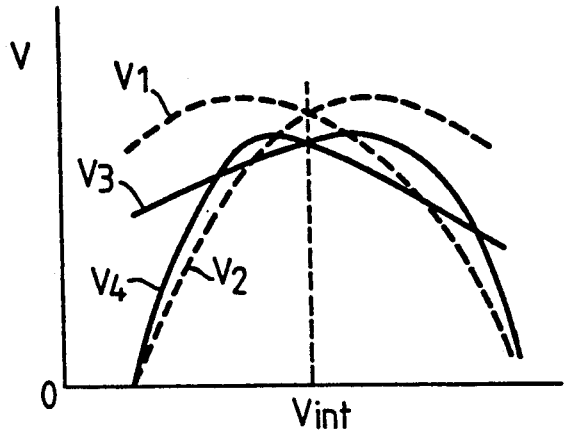

The FIG. 8 shows the way to establish the predetermined voltage $V_{int}$ in accordance with the present invention.

Figure 9:
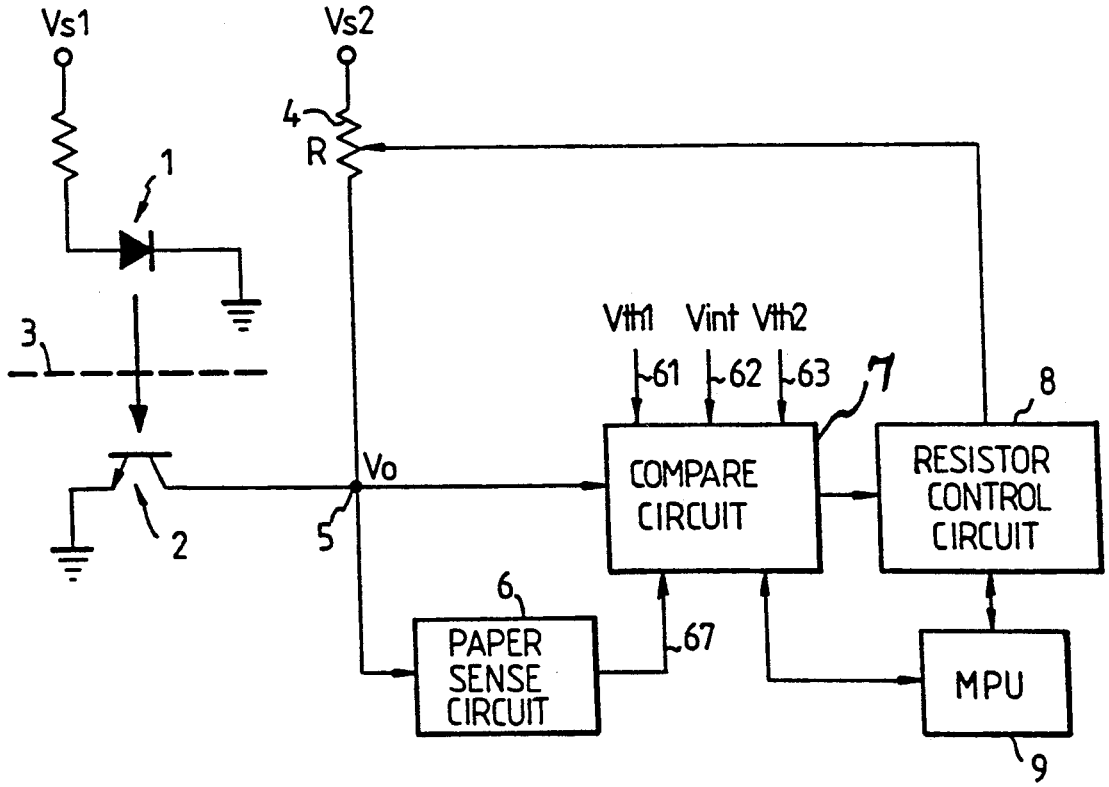

The FIG. 9 shows the apparatus for detecting the overlapped paper sheet feed in accordance with the present invention.

Figure 10:
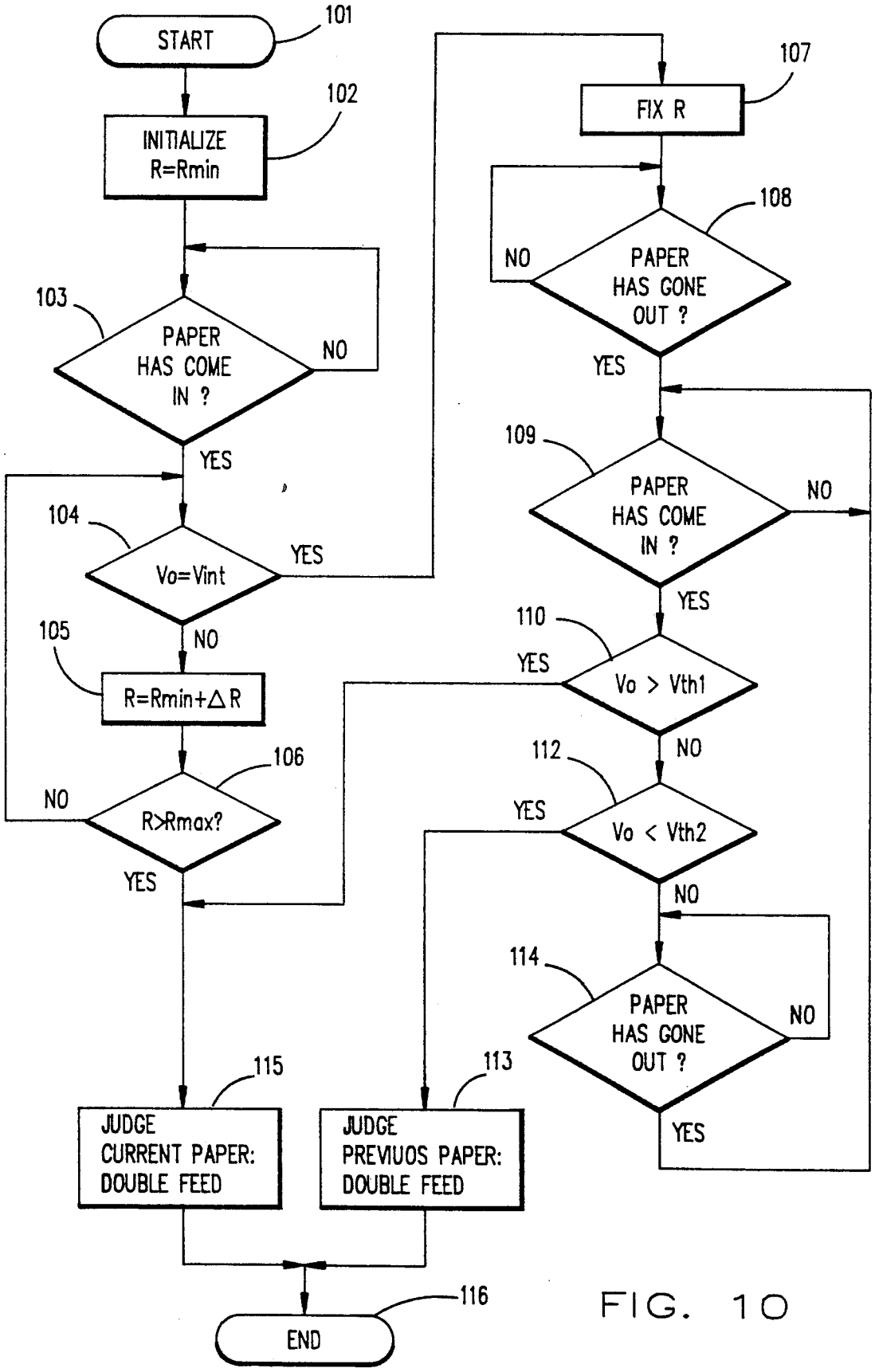

The FIG. 10 shows the flow chart of the operation of the apparatus shown in the FIG. 9, in accordance with the present invention.

Figure 11:
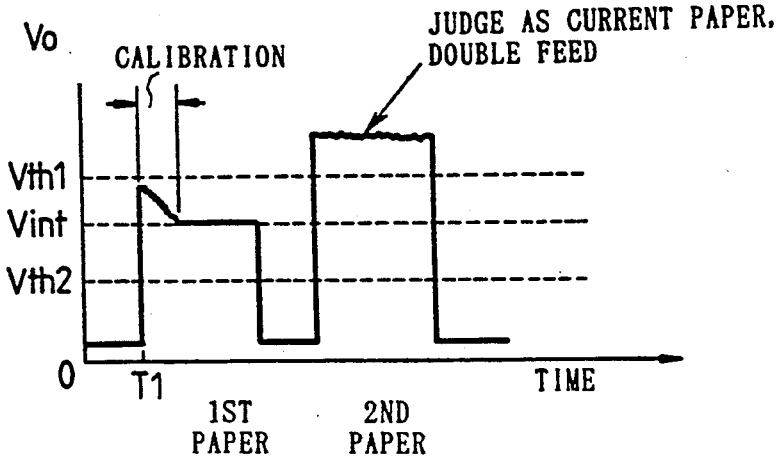
Figure 12:
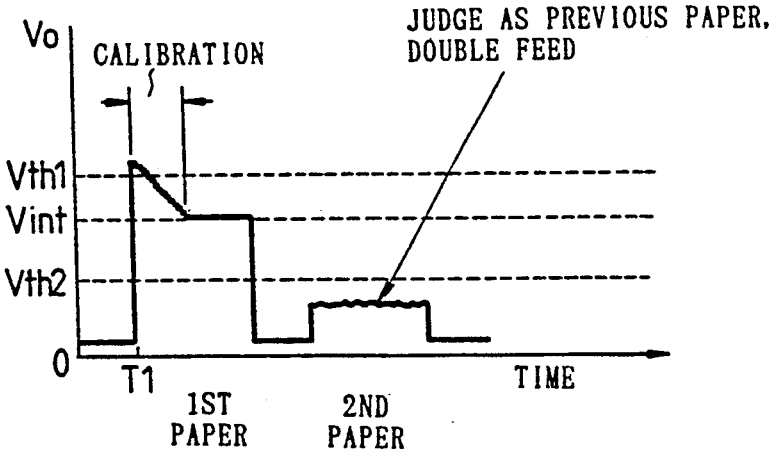
Figure 13:
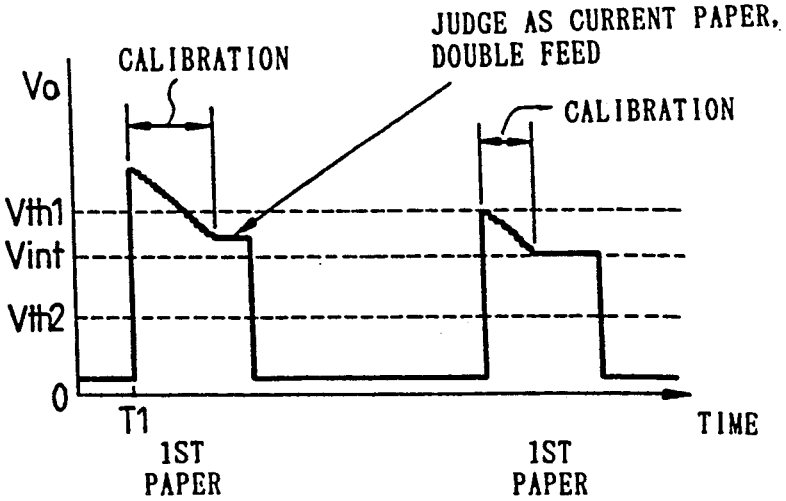

FIGS. 11, 12 and 13 show the waveforms in the various cases for detecting the overlapped paper sheet feed, in accordance with the present invention.

Figure 14:
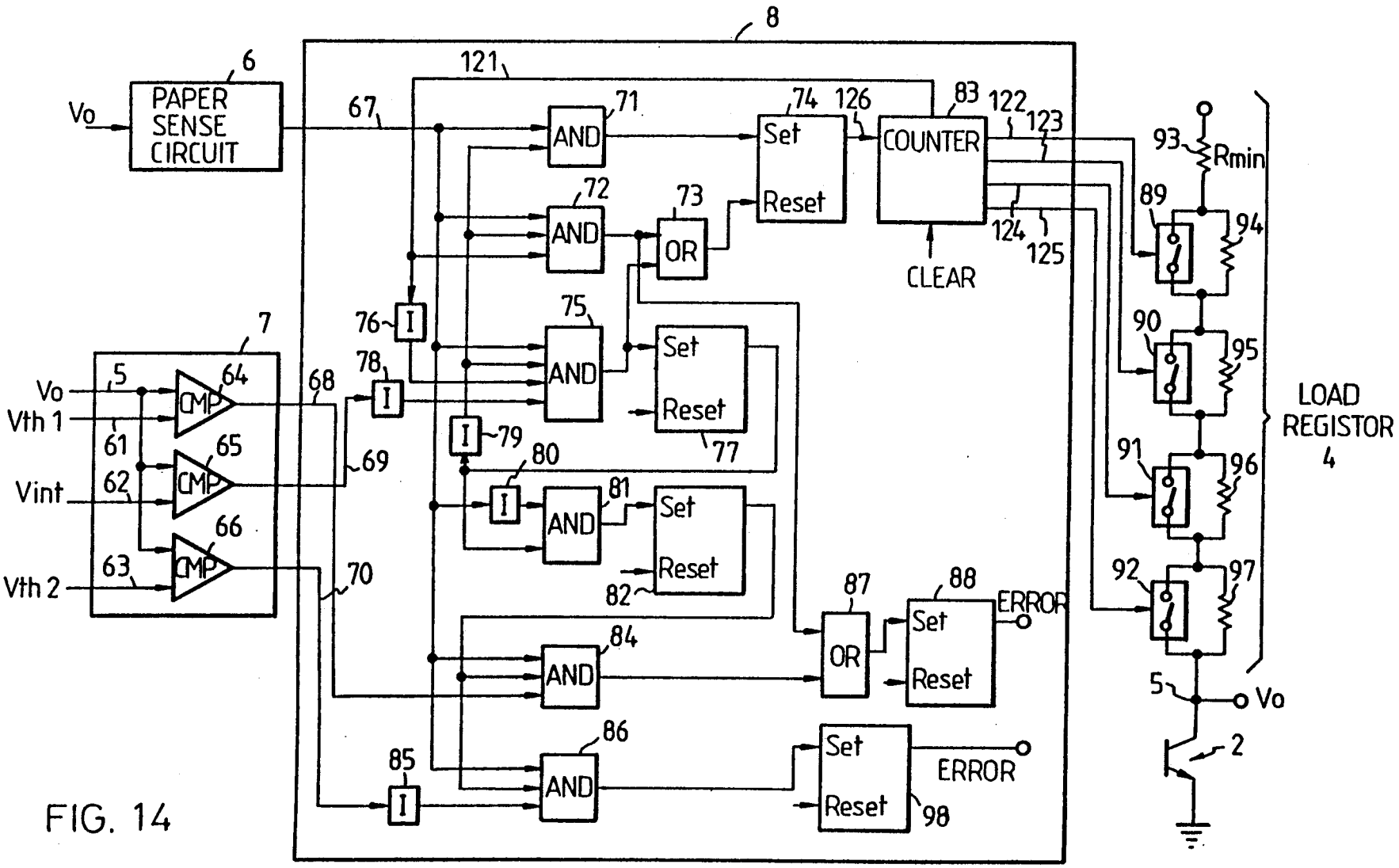
Figure 15:
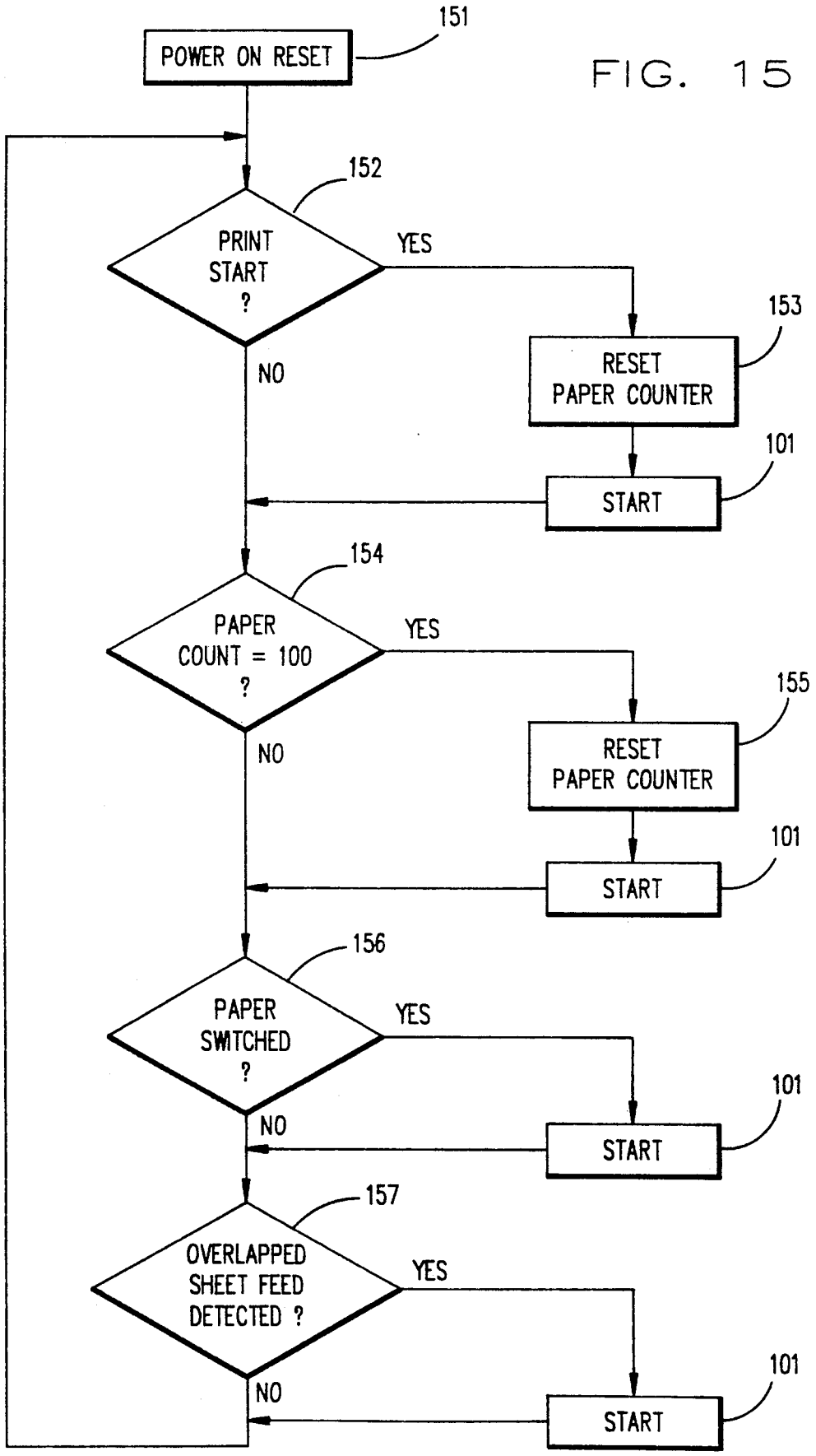

The FIG. 14 shows the detailed circuit of the apparatus of the FIG. 9, in accordance with the present invention. And, The FIG. 15 shows the flow chart starting the algorithm shown in the FIG. 10 in accordance with the present invention.

DETAILED DESCRIPTION

The background of the present invention is initially described.

Figure 1A:
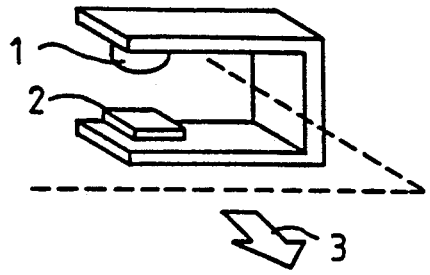
Figure 1B:
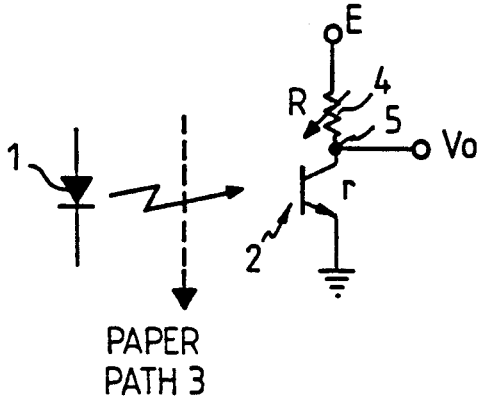

Referring to FIGS. 1A and 1B, a paper sensor including a light emitting diode (LED) 1, a photo transistor 2 and a load resistor 4 is shown. A paper sheet feed path is shown by an arrow 3. A character "r" indicates a resistance value between collector and emitter of the photo transistor 2. Transmitted light through the paper sheet is detected by the photo transistor 2. The value r changes depending upon an amount of transmitted light representing the thickness of the paper sheet or a color of the paper sheet. The load resistor 4 has a resistance value R. The detected voltage $V_0$ is represented, as follows:

$$V_0 = rE/(r+R)$$

The E is the voltage of the power supply.

The apparatus in accordance with the present invention is utilized in a printer, a copying machine, etc. which feeds different kinds of paper sheets into a paper sheet feed path. The different kinds of paper sheets means paper sheets of different thickness and paper sheets of different colors.

For example, a printer has three paper sheet cassettes stacking paper sheets of different thickness, such as 45 kg/860 $m^2$ paper sheets, 75 kg/860 $m^2$ paper sheets and 135 kg/860$m^2$ paper sheets, respectively. The light transmittivity of a paper sheet varies depending upon its thickness.

A printer has two paper sheet cassettes stacking red color separator sheets and white color printing paper sheets, respectively. The light transmittivity of a paper sheet varies depending upon its color. Although the embodiment of the present invention is directed to the discrimination of the feed of two overlapping paper sheets of different thickness, the invention is used to detect the overlapped paper sheet feed of the different colors.

Figure 2:
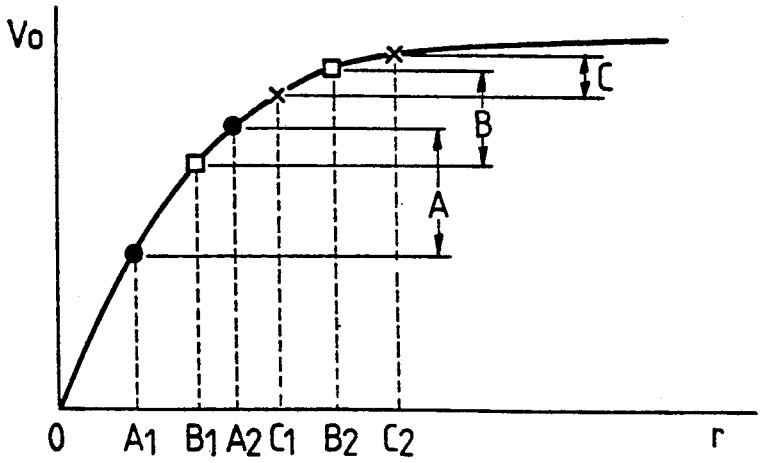

The relationship of the detected voltage $V_0$ and the resistance value r is shown in FIG. 2, when the three kinds of papers, i.e. 45 kg/860 $m^2$ paper sheets, 75 kg/860 $m^2$ paper sheets and 135 kg/860 $m^2$ paper sheets, which are expected for use in the printer, the copying machine, etc. are supplied in the paper sheet feed path 3. $A_1$ represents the value r when one 45 kg/860 $m^2$ paper sheet is fed, $A_2$ represents the value r when two 45 kg/860 $m^2$ paper sheets are fed, $B_1$ represents the value r when one 75 kg/860 $m^2$ paper sheet is fed, $B_2$ represents the value r when two 75 kg/860 $m^2$ paper sheets are fed, $C_1$ represents the value r when one 135 kg/860 $m^2$ paper sheet is fed, and $C_2$ represents the value r when two 135 kg/860 $m^2$ paper sheets are fed. As seen from the FIG. 2, when the value R of the load resistor 4 is a constant value, the range of the detected voltage $V_0$ is varied depending upon the thickness of paper sheet(s) in the paper sheet feed path 3.

Figure 3:
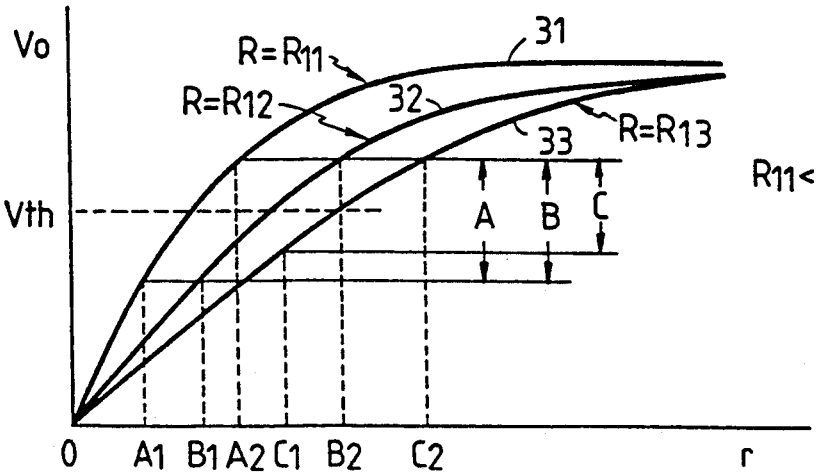

FIG. 3 shows the r-$V_0$ curves 31, 32 and 33 which are obtained by changing the value of the load resistor 4 of the photo transistor 2 to realize ranges A, B and C of substantially the same amplitude. The curve 31 is obtained when $R=R_{11}$, the curve 32 is obtained when $R=R_{12}$, and the curve 33 is obtained when $R=R_{13}$, wherein $R_{11}<R_{12}R_{13}$. A common threshold Vth can be used, which discriminates the thickness of paper sheets, i.e. one paper sheet or two or overlapped paper sheets, supplied through the paper sheet feed path 3.

Figure 4:
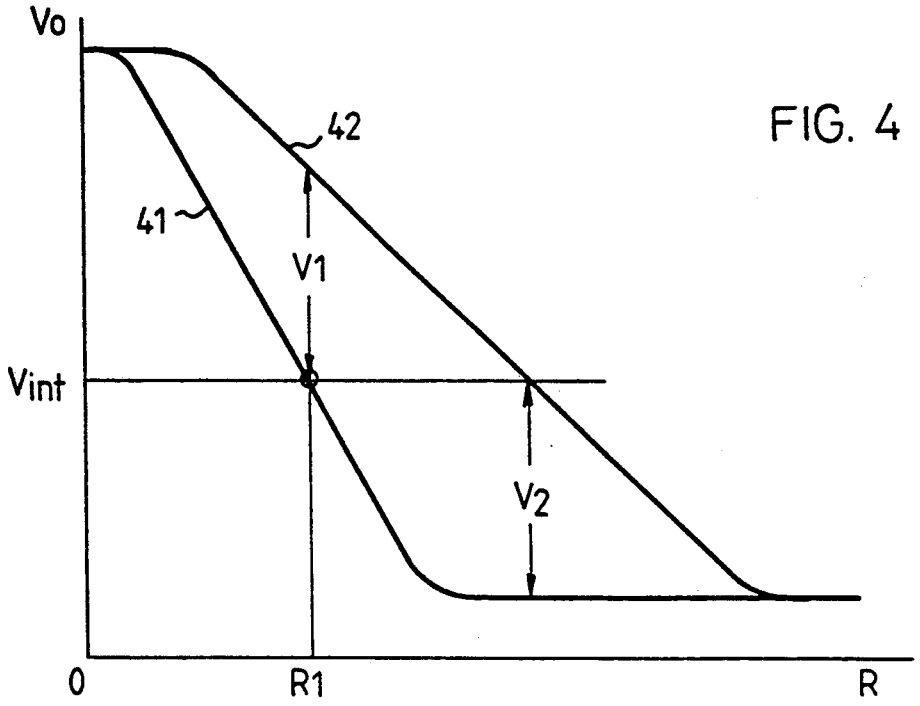
Figure 5:
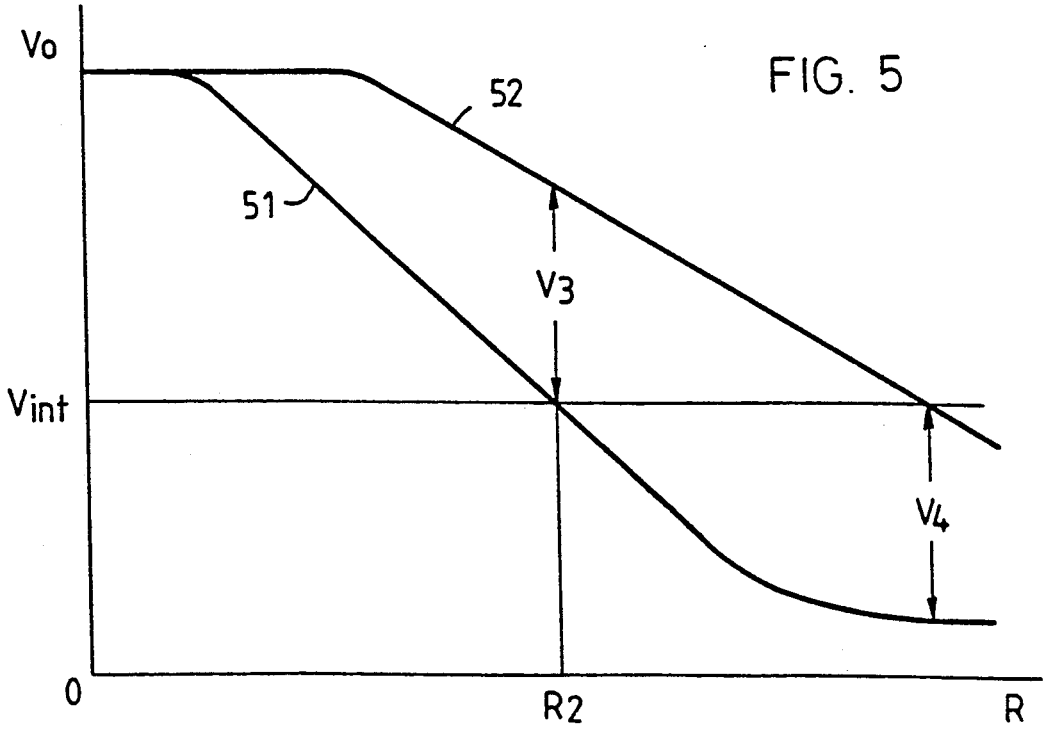

To establish the common threshold values for all kinds of paper sheets and the range of the value R, the R-$V_0$ characteristic curves of the thinnest paper sheet, i.e. the 45 kg/860 $m^2$ paper sheet, and the thickest paper sheet, i.e. the 135 kg/860 $m^2$ paper sheet, are measured by changing the value R of the load resistor 4 of the photo transistor 2. The voltage applied to the LED 1 is maintained to generate light of a constant luminance. The detected voltage $V_0$ represents the amount of transmitted light through the paper sheet in the paper sheet feed path 3. A curve 41 in FIG. 4 represents the R-$V_0$ characteristic curve of one thinnest paper sheet, and a curve 42 represents the R-$V_0$ characteristic curve of two overlapped thinnest paper sheets. A curve 51 in FIG. 5 represents the R-$V_0$ characteristic curve of one thickest paper sheet, and a curve 52 represents the R-$V_0$ characteristic curve of two overlapped thickest paper sheets. In the FIG. 4, an intermediate voltage $V_{int}$ is selected, at which a voltage $V_1$, i.e. a difference between the curves 41 and 42, is equal to a voltage $V_2$, i.e. a difference between the curves 41 and 42. The same value as the $V_{int}$ in the FIG. 4 is used in the FIG. 5, and voltage $V_3$ and $V_4$ are measured. FIG. 8 shows the way for selecting the predetermined voltage $V_{int}$. The vertical axis represents the difference voltage, and the horizontal axis represents the value of $V_{int}$. The value $V_{int}$ is defined by selecting the minimum value among the voltages $V_1$, $V_2$, $V_3$ and $V_4$ at each value of the $V_{int}$ and by selecting a value $V_{int}$ at which the minimum value becomes the largest in the range of $V_{int}$ to obtain the maximum values of the difference voltages $V_1$, $V_2$, $V_3$ and $V_4$.

Figure 6:
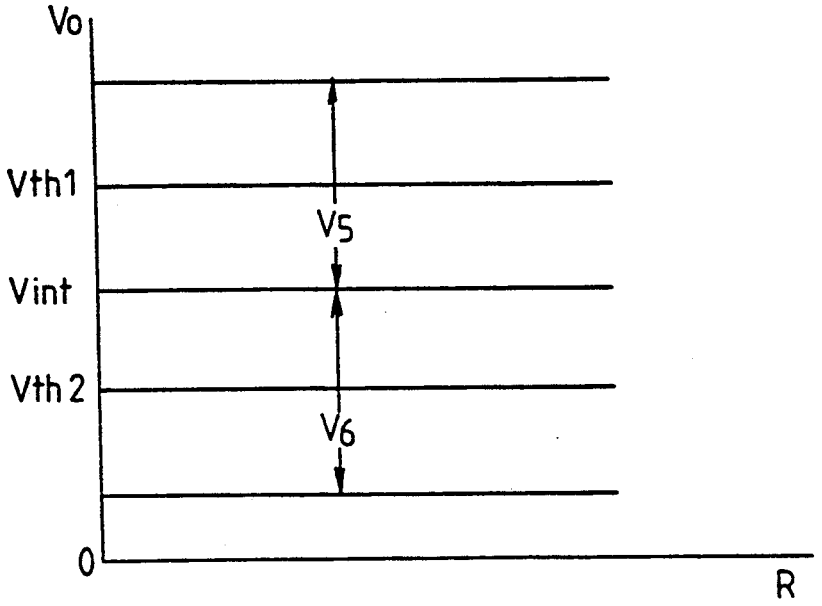

The larger the difference voltage is, the wider is the margin for discriminating between the single feed and the double feed of the paper sheet. A value of difference voltage $V_5$ shown in FIG. 6 is selected from the values $V_1$ and $V_3$, and a difference voltage $V_6$ shown in the FIG. 6 is selected from the values $V_2$ and $V_4$. The practical way for selecting the values $V_5$ and $V_6$ is to select the smallest value between the $V_1$ and $V_3$ and between the $V_2$ and $V_4$. A voltage equally dividing the voltage $V_5$ is selected as the first threshold voltage $Vth_1$, and a voltage equally dividing the voltage $V_6$ is selected as the second threshold voltage $Vth_2$. The first and second threshold voltages $Vth_1$ and $Vth_2$ are the common threshold voltages for the thinnest and thickest paper sheets and the medium paper sheets therebetween. The R-$V_0$ characteristic curve of the 75 kg/860 $m^2$ paper sheet falls between the curves of the thinnest and thickest paper sheets. The threshold values $Vth_1$ and $Vth_2$ are, therefore, used as the common threshold values for all kinds of paper sheets.

Figure 7:
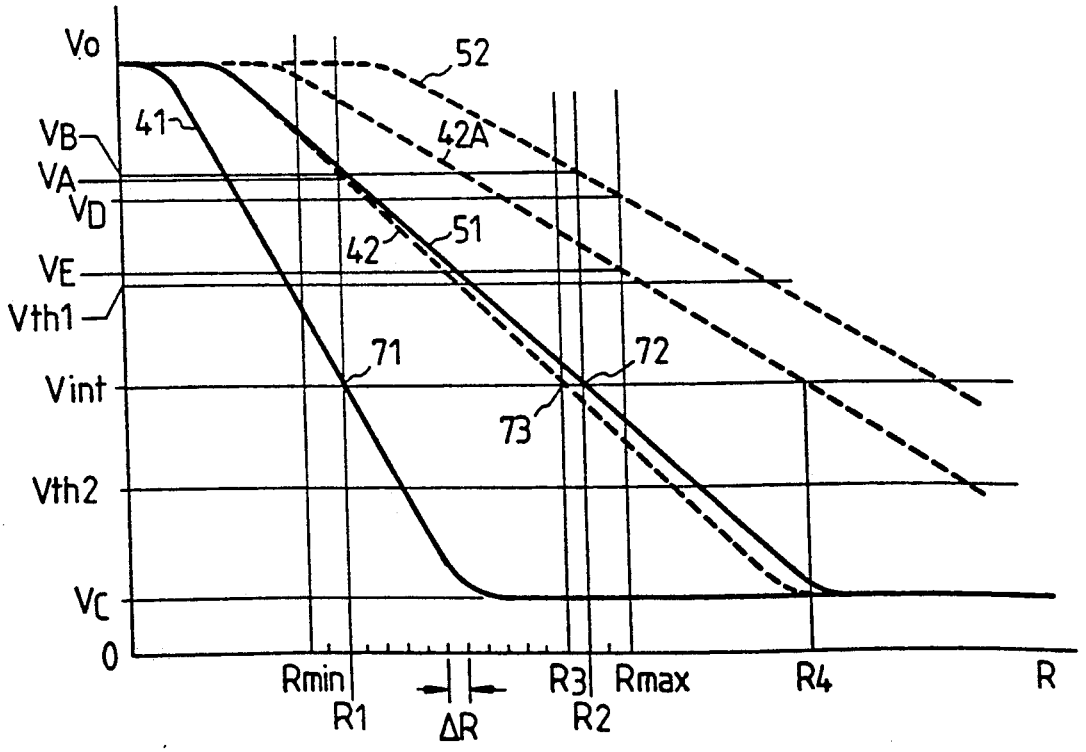

Next, the range of the resistance value R is established, as follows. The curves 41, 42, 51 and 52 are shown in FIG. 7. The crosspoint 71 of the predetermined voltage $V_{int}$ and the curve 41 is at the value $R_1$, and the crosspoint 72 of the $V_{int}$ and the curve 51 is at the value $R_2$. The first resistance value $R_1$ and the second resistance value $R_2$ define the range of the change of the resistance value of the load resistor 4. The range is, however, expanded to a resistance value $R_{min}$ and a resistance value $R_{max}$, due to a consideration that the R-$V_0$ curves are shifted due to variations of the operational characteristic of the LED and the photo transistor and the load resistor caused by variation of operating temperature, dispersion of manufacturing parameters, etc. The $R_1$-$R_{min}$ and $R_{max}$-$R_2$ are the margin of the variations. For example, when the curve 41 crosses the predetermined voltage $V_{int}$ at the value $R_{min}$, the $R_{min}$ is handled as the $R_1$.

The range between the $R_{min}$ and $R_{max}$ is divided into plural sections, e.g. 16 sections, each of which has a value $\Delta R$. The value of the load resistor 4 of the photo transistor 2 is, therefore, varied between the $R_{min}$ and $R_{max}$.

In this manner, the R-$V_0$ curves 41, 42, 51, and 52 of the expected thinnest paper sheet and the expected thickest paper sheet are preliminarily measured in the design stage of the printer to find out the predetermined (detected) voltage $V_{int}$, the first and second threshold voltages $Vth_1$ and $Vth_2$, the first resistance value $R_1$ corresponding to the predetermined voltage $V_{int}$ on the curve 41 at the feed of single thinnest paper sheet, and the second resistance value $R_2$ corresponding to the predetermined voltage $V_{int}$ on the curve 51 at the feed of single thickest paper sheet. And, the above values are used in the algorithm of the present invention.

The purpose of varying the resistance value of the load resistor 4 between the value $R_{min}$ and the value $R_{max}$ is to determine or discriminate as to whether the detected voltage $V_0$ of the first paper sheet(s) in the paper sheet feed path 3 becomes equal to the predetermined intermediate voltage $V_{int}$, or not. An algorithm of the present invention, described hereinafter with reference to FIG. 10, tentatively considers that the first paper sheet(s) in the paper sheet path 3 is a single paper sheet if the detected voltage $V_0$ of the first paper sheet(s) becomes equal to the predetermined intermediate voltage $V_{int}$; and does not generate the alarm or error signal. There are two cases wherein the detected voltage $V_0$ becomes equal to the predetermined voltage $V_{int}$. The first case occurs when one paper sheet of the thinnest or thickest paper sheet is fed into the paper sheet feed path 3. In the first case, (a) the detected voltage $V_0$ of one thinnest paper sheet is decreased to the predetermined voltage $V_{int}$ at the crosspoint 71 along the curve 41 when the value of the load resistor 4 is increased to the value $R_1$, or (b) the detected voltage $V_0$ of one thickest paper sheet is decreased to the predetermined voltage $V_{int}$ at the crosspoint 72 along the curve 51 when the value of the load resistor 4 is increased to the value $R_2$. The value of the load resistor 4 is fixed to the value $R_1$ for one thinnest paper sheet, or the value $R_2$ for one thickest paper sheet, respectively. The operation for setting the resistance value of the load resistance 4 is called as a calibration operation or initial set up operation. And, the fixed resistance value of the load resistor 4 is used for detecting the double feed of the subsequent paper sheets, i.e. the second paper sheet, the third paper sheet, etc. If the first one paper sheet is the thinnest paper sheet, the resistance value of the load resistor 4 is set to the value $R_1$. When the second paper sheet(s) is two overlapped thinnest paper sheets, the detected voltage $V_0$ at the connecting node 5 in the FIG. 9 is equal to a voltage $V_A$, as shown in the FIG. 7. The voltage $V_A$ is higher than the first threshold voltage $Vth_1$, and so the feed of two paper sheets is detected.

If the first paper sheet is one thickest paper sheet, the resistance value of the load resistor 4 is set to the value $R_2$. When the second paper sheet(s) is two overlapped thickest paper sheets, the detected voltage $V_0$ at the connecting node 5 in the FIG. 9 is equal to a voltage $V_B$, as shown in the FIG. 7. The voltage $V_B$ is higher than the first threshold voltage $Vth_1$, and so the feed of two overlapped paper sheets is detected.

The waveforms in the first case are shown in FIG. 11, wherein the detected voltage $V_0$ reaches the predetermined voltage $V_{int}$ during the calibration period, and the feed of the second paper sheets generating a higher voltage than the first threshold voltage $Vth_1$ is judged as the double feed.

The second case wherein the detected voltage $V_0$ becomes equal to the predetermined voltage $V_{int}$ during the calibration operation occurs when the curve 42 of two overlapped thinnest paper sheets shown in the FIG. 4 crosses the voltage $V_{int}$ at a crosspoint 73 between the $R_{min}$ and the $R_{max}$, and the two overlapped thinnest paper sheets are fed into the paper sheet feed path 3 as the first paper sheets. During the calibration operation, the detected voltage $V_0$ reaches the predetermined voltage $V_{int}$ at the resistance value $R_3$, and the resistance value is set to the value $R_3$. It is noted that the detected voltage $V_0$ generated by the transmitted light through the first fed two overlapped thinnest paper sheets becomes equal to the predetermined voltage $V_{int}$ during the calibration period. Therefore, the algorithm consider that the first fed two overlapped paper sheets are a single paper sheet, and does not generate an alarm or error signal indicating the double feed of the paper sheets at the feed of the first paper sheets.

When the second paper sheet fed into the paper sheet feed path 3 is one or single thinnest paper sheet (after the resistance value of the load resistor 4 is fixed to the value $R_3$) a voltage $V_c$ is detected at the connecting node 5. The detected voltage $V_c$ is smaller than the second threshold voltage $Vth_2$. The facts (a); that the detected voltage $V_0$ of the first paper. sheet(s) is decreased to the predetermined voltage $V_{int}$ during the calibration operation, and (b); that the detected voltage $V_0$ of the second paper sheet is lower than the second threshold voltage $Vth_2$, indicate that the first paper sheet(s) was the two overlapped thinnest paper sheets and the second paper sheet is one thinnest paper sheet, so that an alarm or error signal representing that the previous or first paper sheet(s) was the double feed is generated at the feed of the second paper sheet.

The waveforms in the second case are shown in FIG. 12, wherein the detected voltage $V_0$ at the connecting node 5 of the first paper sheets reaches the predetermined voltage $V_{int}$ during the calibration period, and the detected voltage $V_0$ lower than the second threshold voltage $Vth_2$ is generated during the feed of the second paper sheet.

The third case occurs when the detected voltage $V_0$ of the first paper sheet(s) at the connecting node 5 does not reach the predetermined intermediate voltage $V_{int}$ during the calibration operation. More particularly, the third case typically occurs when plural overlapped thickest paper sheets are fed into the paper sheet feed path 3. Referring to the FIG. 7, the detected voltage $V_0$ of the two overlapped thickest paper sheets varies along the curve 52. When the resistance value R of the load resistance 4 is increased to the maximum value $R_{max}$, the detected voltage $V_0$ merely reaches a voltage $V_D$; in other words, the detected voltage $V_0$ does not become equal to the predetermined voltage $V_{int}$, during the calibration operation. The fact that the detected voltage $V_0$ does not reach the $V_{int}$ is discriminated as the feed of at least two overlapped paper sheets during the calibration operation.

The third case also occurs when the curve 42 in the FIG. 4 of two overlapped thinnest paper sheets traces the curve 42A in the FIG. 7, and the two overlapped thinnest paper sheets are fed into the paper sheet feed path 3 as the first paper sheet. It is noted that the decrease of the detected voltage $V_0$ at the connecting point 5 during the calibration period is stopped at a voltage $V_E$, as shown in the FIG. 7. The fact that the detected voltage $V_0$ does not reach the predetermined voltage $V_{int}$ is discriminated as the feed of two overlapped paper sheets during the calibration period. Hence an alarm or error signal indicating that the first paper sheet is the double feed is generated.

The waveforms in the third case are shown in FIG. 13, wherein the detected voltage $V_0$ at the connecting node 5 of the first paper sheets does not reach the predetermined voltage $V_{int}$ during the calibration. In the above manner, the invention discriminates the feed of one paper sheet and the feed of two overlapped paper sheets, irrespective of types of paper sheets supplied into the paper sheet feed path 3.

FIG. 9 shows a block diagram of the apparatus in accordance with the present invention, which detects the feed of the overlapped paper sheets of any kind of paper sheet. The LED 1 generates the light of a constant luminance, and the transmitted light through the paper sheet(s) in the paper sheet feed path 3 is detected by the photo transistor 2. A voltage source, such as +5.0 V, is connected to the photo transistor 2 through the load resistor 4. The detected voltage $V_0$ representing the thickness or light transmittivity of the paper sheet(s) in the paper sheet feed path 3 is generated at a connecting node 5. The detected voltage $V_0$ is applied to a paper sense circuit 6, which generates an up level signal when the paper sheet exists between the LED 1 and the photo transistor 2. The detected voltage $V_0$ representing the light transmittivity, i.e. thickness and color, of the paper sheet(s) and the output signal of the paper sensing circuit 6 are applied to a compare circuit 7. The compare circuit 7 compares the detected voltage $V_0$ with the threshold voltage $Vth_1$, $V_{int}$ and $Vth_2$ to generate control signal which is supplied to a resistor control circuit 8 or to generate an error signal which is supplied to a control device or microprocessor (MPU) 9. The resistor control circuit 8 responds to the control signal from the compare circuit 7 by changing the resistance value R of the load resistor 4 as necessary.

The MPU 9 controls the operations of the circuits in FIG. 9. The detected voltage $V_0$ is applied to both the paper sense circuit 6 and compare circuit 7; hence only one paper sensor, i.e. the LED 1 the photo transistor 2 and the load resistor 4, is required. The paper sheet feed mechanism is not shown in the drawings, since the mechanism is well known in the art.

FIG. 10 shows an algorithm performed by the circuits shown in FIG. 9 for discriminating the feed of overlapped paper sheets in the paper sheet feed path 3. The algorithm could be divided into two parts. The first part includes the blocks 101 through 108, 115 and 116. The second part includes the blocks 109 through 116.

The first part performs the calibration operation wherein the algorithm considers that the first paper sheet(s) in the paper sheet feed path 3 is a single paper sheet if the detected voltage $V_0$ of the first paper sheets becomes equal to the predetermined voltage $V_{int}$ during the change of the resistance value R of the load resistor 4 in the range defined by the value $R_{min}$ and the value $R_{max}$; the algorithm fixes the resistance value of the load resistor 4 to the value between the value $R_{min}$ and the value $R_{max}$ at which $V_0=V_{int}$ and the algorithm proceeds to the second part without generating the alarm or error signal. If the detected voltage $V_0$ of the first paper sheet(s) cannot be decreased to the predetermined voltage $V_{int}$ within the resistance range $R_{min}$-$R_{max}$, the algorithm discriminates this condition as the error and generates the alarm or error signal representing that at least two overlapped paper sheets are fed into the paper sheet feed path 3, and the algorithm re-starts the first part of the calibration operation when the next paper sheet(s) is fed into the paper sheet feed path 3.

The second part discriminates as to whether the subsequent paper sheets, i.e. the second, third, fourth, . . . paper sheets are the overlapped paper sheet, or not, and as to whether the first or previous paper sheets were the overlapped sheet, or not.

In the second part, the resistance value of the load resistor 4 fixed in the calibration period is used for the succeeding paper sheets. If the first paper sheet is one thinnest paper sheet, the value $R_1$ in the FIG. 7 is used in the second part. If the first paper sheet is one thickest paper sheet, the value $R_2$ is used in the second part. If the first sheet is one 75 kg/860 $m^2$ paper sheet, a resistance value at which the detected value $V_0$ becomes equal to the predetermined voltage $V_{int}$ is used in the second part. And, if the first paper sheets are two overlapped paper sheets and the detected voltage $V_0$ becomes equal to the predetermined voltage $V_{int}$ at the resistance value $R_3$, the value $R_3$ is used in the second part. The second part of the algorithm compares the detected voltage $V_0$ representing the light transmittivity of the next paper sheet(s) with the first threshold voltage $Vth_1$ to determine as to whether the paper sheet(s) is plural overlapped paper sheets, or not; if not, it then compares the detected voltage $V_0$ with the second threshold voltage $Vth_2$ to determine as to whether the previous paper sheet(s) is two overlapped paper sheets, or not.

If the algorithm detects the feed of the plural overlapped paper sheets, the algorithm generates the alarm or error signal, and returns the operation to the first part.

Referring to the FIG. 10, the MPU 9 starts the algorithm at a block 101 in response to a depression of a print start button by an operator, for example. The activation of the start block 101 is described hereinafter with reference to FIG. 15. The operation proceeds to a block 102, wherein the MPU 9 controls the resistor control circuit 8 to set the value R of the load resistor 4 to the initial value $R_{min}$. The operation proceeds to a block 103, wherein the MPU 9 determines as to whether the up level signal indicating the existence of the first paper sheet in the paper sheet feed path 3 has been generated by the paper sense circuit 6, or not. If the answer of the block 103 is NO, the operation returns to the block 103. If the answer of the block 103 is YES, the operation proceeds to a block 104, wherein the detected voltage $V_0$ is compared with the predetermined voltage $V_{int}$ by the compare circuit 7. If the answer of the block 104 is YES, the operation proceeds to a block 107, wherein the current value of the load resistor 4 is fixed. If the answer of the block 104 is NO, the operation proceeds to a block 105, wherein the current value $R_{min}$ of the load resistor 4 is incremented by $\Delta R$ under the control the compare circuit 7 and the resistor control circuit 8. By increasing the resistance value of the load resistor 4, the detected voltage $V_0$ at the connecting node 5 is gradually decreased to the predetermined voltage $V_{int}$, as shown in the FIG. 7.

The operation proceeds to a block 106, wherein the MPU 9 determines as to whether the value R is larger than the $R_{max}$, or not. If the answer of the block 106 is NO, the operation returns to the block 104. If the answer of the block 106 is YES, which is generated in the cases of curves 42A and 52 shown in the FIG. 7, the operation proceeds to a block 115, wherein the error signal generated in the block 115 is sent to the first error signal input port of the MPU 9, which responds to the signal by stopping the print operation including the paper feed operation and turning on the alarm indicator indicating that the first paper sheet feed is an error.

The MPU 9 has the first and second error signal input ports. The first error signal input port is connected to the block 115; so that the MPU 9 knows the error condition of the block 115 when the error signal is applied to the first error signal input port. The second error signal input port is connected to a block 113; so that the MPU 9 knows the error condition of the block 113 when the error signal is applied to the second error signal input port.

The block 115 is followed by the block 116, wherein the operation is terminated, and the MPU 9 re-starts the operation at the block 101.

In the cases of the curves 41, 42, and 51 shown in the FIG. 7, the operation circulates through the blocks 104, 105 and 106, and the status $V_0=V_{int}$ is finally detected by the block 104, and the operation proceeds to a block 109, which determines whether the next paper sheet(s) is fed into the paper sheet feed path 3. If the answer of the block 109 is NO, the operation returns to the block 109. If the answer of the block 109 is YES, the operation proceed to a block 110, which determines whether the detected voltage $V_0$ representing the light transmittivity of the next paper sheet is larger than the first threshold voltage $Vth_1$, or not. It is noted that the detected voltage $V_0$ generated at the connecting node 5 is decided by the resistance value fixed by the block 107 and the intensity of illumination received by the photo transistor 2.

If the answer of the block 110 is YES, the feed of the current paper sheets is judged as the plural overlapped feed in a block 115, wherein the error signal generated is sent to the first error signal input port of the MPU 9, which responds to the error signal by stopping the print operation and turning on the alarm indicator indicating that the current feed is an error. Then, the MPU 9 returns the operation to the block 101. If the answer of the block 110 is NO, the operation proceeds to a block 112, which determines whether the detected voltage $V_0$ is smaller than the second threshold voltage $Vth_2$, or not. If the answer of the block 112 is YES, the double feed of the first or previous paper sheets is detected in a block 113, and the error signal is sent to the second error signal input port of the MPU 9, which responds to the error signal by stopping the print operation and turning on the alarm indicator indicating that the previous paper feed was an error. The operation using the resistance value fixed by the block 107 is terminated at the block 116, and the MPU 9 re-starts the operation at the block 101 by which new calibration operation for the next paper sheet is started.

The block 115 detects the feed of plural paper sheets as shown in the FIGS. 11 and 13, and the block 113 detects the feed of two overlapped paper sheets as shown in the FIG. 12 which relates to the curve 42 in the FIG. 7.

If the answer of the block 112 is NO, the operation proceeds to the block 114 which determines whether the current paper sheet has been ejected to an output tray from the paper sheet feed path 3, or not. If the answer of the block 114 is NO, the operation returns to the block 114. If the answer is YES, the operation returns to the block 109.

FIG. 14 shows the details of the circuits shown in the FIG. 9. The compare circuit 7 includes comparators 64, 65 and 66. The detected voltage $V_0$ generated at the connecting node 5 is applied to the comparators 64, 65 and 66. The threshold voltages $Vth_1$, $V_{int}$ and $Vth_2$are supplied to the comparators 64, 65 and 66, respectively. An up level signal on an output line 68 of the comparator 64 represents $V_0 > Vth_1$, and a down level signal on the output line 68 represents $V_0 = \leqq Vth_1$ An up level signal on an output line 69 of the comparator 65 represents $V_0 > V_{int}$, and a down level signal on the output line 69 represents $V_0 = V_{int}$. An up level signal on an output line 70 of the comparator 66 represents $V_0 = > Vth_2$, and a down level signal on the output line 70 represents $V_0 < Vth_2$.

The resistor control circuit 8 includes AND gates 71, 72, 75, 81, 84 and 86, inverters 76, 78, 79, 80 and 85, OR gates 73 and 87, latches 74, 77, 82, 88 and 98 and a counter 83.

The load resistor 4 comprises resistors 93, 94, 95, 96 and 97. The resistor value of the resistor 93 is $R_{min}$. The ratio of the values of the resistors 94, 95, 96 and 97 is 1:2:4:8. Switching circuits 89, 90, 91 and 92 are connected to the resistors 94, 95, 96 and 97 in parallel, respectively. The switching circuits 89 through 92 are controlled by the counter 83.

All the latches 74, 77, 82, 88, and 98 are reset and the counter 83 is cleared to the value 0 by the block 102 in the FIG. 10.

An up level signal on an output line 121 of the counter 83 represents that the count value is equal to the maximum count value, e.g. value 16, and a down level signal indicates that the count value is not equal to the maximum value. The counter 83 is incremented during the existence of an up level signal on a line 126 of the latch 74. The increment is stopped by a down level signal on the line 126.

An up level signal on an output line 67 of the paper sense circuit 6 indicates the existence of the paper sheet(s) in the paper sheet feed path 3, and a down level signal represents the non-existence of the paper sheet.

At the block 102 in the FIG. 10, the signals on the lines 122, 123, 124 and 125 of the counter 83 are down level indicating the count value 0, so that all the switching circuits 89, 90, 91 and 92 are closed and the resistance value of the load resistor 4 is set to the value $R_{min}$, and the output signals of the latches 74, 77, 82, 88 and 98 are down level. The down level signal of the latch 74 stops the increment of the counter 83.

When the paper sense circuit 6 senses the paper sheet(s) in the paper sheet feed path 3 as indicated by the output YES of the block 103 in the FIG. 10, the up level signal is generated on the line 67 to condition the first input of the AND gate 71, the second input of the AND gate 71 is also up level since the down level signal of the latch 77 is inverted by the inverter 79, whereby the AND gate 71 is activated and sets the latch 74 which generates the up level signal.

As the paper sheet(s) is fed in the paper sheet feed path 3, the transmitted light through the paper sheet(s) is detected by the photo transistor 2, and the detected voltage $V_0$ is compared with the reference or predetermined voltage $V_{int}$ by the block 104 in the FIG. 10. This operation is performed by the comparator 65 in the FIG. 14, which generates the up level signal when $V_0 > V_{int}$ and the down level signal when $V_0 = V_{int}$. The comparator 65 initially generates the up level signal, which is inverted by the inverter 78, so that the AND gate 75 is not activated and generates the down level signal on its output. The down level signal is supplied to the second input of the OR gate 73. The first input of the OR gate 73 is supplied from the AND gate 72, which does not generate the up level signal at this time since the count value of the counter 83 does not reach the maximum value 16 and the down level signal is generated on the line 121, whereby the OR gate 73 generates the down level signal, and the latch 74 which was set by the AND gate 71 is not reset. The latch 74 is generating the up level signal due to the up level signal from the AND gate 71, as stated hereinbefore, so that the counter 83 has been incremented to a count value which represents the time period of the up level signal from the latch 74. The up level signals on the lines 122, 123, 124 and 125 represent the binary number 1, 2, 4 and 8, respectively. The counter 83 generates the up level signals representing its count value on the lines 122, 123, 124 and 125. The up level signal supplied to the switching circuit 89 through 92 opens the switch. For example, if the count value is 1, the counter 83 generates the up level signal on the line 122, which opens the switching circuit 89 only, so that the resistance value of the resistor 94 representing the binary value 1 is added to the resistor $R_{min}$. If the count value is 2, only the switching circuit 90 is opened and the remaining switching circuits 89, 91 and 92 are closed, so that the resistance value of the resistor 95 representing the binary value 2 is added to the resistor 93.

In this manner, the resistance value of the load resistor 4 is gradually increased as shown by the block 105 in the FIG. 10. The operation of the next block 106 is performed by the AND gate 72. If the count value or the resistance value does not reach the maximum value, the signal on the line 121 is the down level signal, so that the AND gate 72 is not activated and the down level signal is supplied to the latch 74 through the OR gate 73, whereby the increment of the count value or the resistance value is not stopped.

When the comparator 65 detects the status $V_0 = V_{int}$ in the block 104 in the FIG. 10, it generates the down level signal on its output, which is inverted to the up level signal by the inverter 78. The up level signal is supplied to the fourth input of the AND gate 75. It is noted that the first, second and third input signals to the AND gate 75 are the up level signals, whereby the AND gate 75 is activated to generate the up level signal on its output. The up level signal is supplied to the reset input of the latch 74 through the OR gate 73, and the latch is reset to stop the up level signal on the line 126, so that the counter 83 is stopped, and the count value or the resistance value of the load resistor 4 is fixed, as shown by the block 107 in the FIG. 10.

The up level signal of the AND gate 75 is also supplied to the latch 77 to switch it from the reset state to the set state, so that the latch 77 generates the up level signal on its output.

When the paper sheet(s) is ejected from the viewing range of the photo transistor 2, the paper sense circuit 6 generates the down level signal on its output line 67. At this time, the calibration operation for setting the resistance value of the load resistor 4 is completed, and the count value or the resistance value of the load resistor 4 is fixed, and the output signal of the latch 77 is maintained at the up level. The up level signal of the latch 77 is used to condition the second input of the AND gate 81. The first input of the AND gate 81 is supplied with the up level signal through the inverter 80 when the first paper sheet(s) is ejected from the viewing range of the photo transistor 2, so that the AND gate 81 generates the up level signal which is supplied to the latch 82 to switch its state from the reset to the set. This up level signal is used to condition the AND gates 84 and 86 for detecting the overlapped feed of the succeeding paper sheets.

Now describing the operation when the block 106 in the FIG. 10 generates the answer YES, when the count value reaches the maximum value 16, the counter 83 generates the up level signal on the line 121, which activates the AND gate 72, so that the up level signal is supplied to the latch 74 through the OR gate 73 to stop the count operation at the maximum count value 16. The up level signal of the AND gate 72 is also supplied to the latch 88 through the OR gate 87 to set the latch 88, so that the latch 88 generates on its output the up level signal representing that the current paper feed is the overlapped feed. This up level signal or error signal is supplied to the first error signal input port of the MPU 9, as described hereinbefore with reference to the blocks 115 and 116 in the FIG. 10.

If the calibration operation of the first part of the algorithm in the FIG. 10 is terminated at the block 108, the apparatus is waiting for the next paper sheets, and the resistance value of the load resistor 4 is fixed at the value, e.g. the value $R_1$, $R_2$ or $R_3$, in the range $R_{min}$–$R_{max}$.

When the next paper sheet(s) is fed into the paper sheet feed path 3 and is detected by the photo transistor 2, the paper sense circuit 6 generates the up level signal on the line 67, as shown by the answer YES of the block 109 in the FIG. 10, which conditions the first inputs of the AND gates 84 and 86. The second inputs of the AND gates 84 and 86 are conditioned by the up level signal from the latch 82, which was set during the calibration operation on the first paper sheet(s).

The operation for comparing the detected voltage $V_0$ of the second paper sheet with the first threshold $Vth_1$ in the block 110 in the FIG. 10 is performed by the comparator 64 in the FIG. 14. If the detected voltage $V_0$ of the next or second paper sheet(s) is higher than the threshold voltage $Vth_1$, the comparator 64 generates the up level signal which conditions the third input of the AND gate 84, so that the AND gate 84 is activated to generate the up level signal which is supplied to the latch 88 through the OR gate 87, and the latch 88 is set to generate the error signal indicating that the current paper sheet feed is the double feed. This error signal is supplied to the first error signal input port of the MPU 9. The MPU 9 turns on the alarm indicator and stops the print operation, and terminates the operation of the algorithm at the block 116 in the FIG. 10. Then the MPU 9 re-starts the operation at the block 101. The operation in this case is shown in the FIG. 11.

If the detected voltage $V_0$ of the second paper sheet is not larger than the threshold voltage $Vth_1$, as indicated by the answer No of the block 110, the comparator 64 generates the low level signal on the line 68.

Next, the detected voltage $V_0$ of the paper sheet is compared with the second threshold voltage $Vth_2$ by the comparator 66, as shown by the block 112 in the FIG. 10. If the detected voltage $V_0$ is equal to or larger than the second threshold voltage $Vth_2$, the comparator 66 generates the up level signal and the AND gate 86 is not activated. If the detected voltage $V_0$ is smaller than the threshold voltage $Vth_2$, the comparator 66 generates the down level signal on the line 70. The down level signal is inverted to the up level signal by the inverter 85, so that the AND gate 86 is activated to switch the state of the latch 98 from the reset state to the set state. The latch 98 generates on its output the up level signal indicating that the previous or first paper sheet feed was the plural overlapped sheet-feed. This case is shown in the FIG. 12. This signal is supplied to the second error signal input port of the MPU 9, as described hereinbefore. The MPU 9 turns on the alarm indicator and stops the print operation, and terminates the operation of the algorithm at the block 116 in the FIG. 10. And, the MPU 9 re-starts the operation at the block 101 in the FIG. 10. FIG. 15 shows a flow chart to start the start block 101 in the FIG. 10. In a block 151, the printer, copying machine, etc. into which the apparatus and method of the present invention is incorporated is powered on, and the power on reset status is established wherein the printer is waiting for a depress of a print start button by an operator or an arrival of a print command from a host unit. The operation proceeds to a block 152 which determines as to whether the print start button has been depressed, or the print command has been received, or not. If the answer of the block 152 is YES, the operation proceeds to a block 153 wherein a paper counter counting the number of paper sheets fed into the paper sheet feed path 3 is reset to the count value 0. The operation proceeds to the block 101 which is shown in the FIG. 10 to start the algorithm in the FIG. 10, and the operation proceeds to a block 154. If the answer of the block 152 is NO, the operation proceeds to the block 154. The block 154 determines whether the count value of the paper counter has reached a predetermined number. e.g. a value 100, or not. If the answer of the block 154 is YES, the operation proceeds to blocks 155 and 101, the operations of which are the same as that of the blocks 153 and 101, and the operation proceeds to a block 156. If the answer of the block 154 is NO, the operation proceeds to the block 156 which determines as to whether the paper sheet feed is switched between or among the paper sheet cassettes stacking the various kinds of paper sheet, respectively, or not. If the answer of the block 156 is YES, the operation proceeds to the block 101 in the FIG. 10. If the answer of the block 156 is NO, the operation proceeds to the block 157 which determines as to whether the overlapped paper sheet is detected and the operations of the algorithm of the FIG. 10 is terminated at the block 116. If the answer of the block 157 is YES, the operation proceeds to the block 101. If the answer of the block 157 is NO, the operation returns to the block 152.

It is noted that the start block 101 of the algorithm in the FIG. 10 is started in response to one of the print start signal, the signal indicating that the number of paper sheet reaches the predetermined number, the signal indicating the switch of paper cassette, and the termination of the algorithm of the FIG. 10.

In the embodiment described hereinbefore, the operation shown in the FIG. 10 is made one time per one paper sheet due to the assumption that all of the paper sheets supplied through the paper sheet feed path are blank paper sheets It is required, however, to print characters on pre-printed paper sheet in bank business, life insurance business, etc. For example, paper sheets on which ruled lines and some characters have been pre-printed are used. The pre-printed portion of a paper sheet represents the low light transmittivity, while the blank portion of the paper sheet represents the high light transmittivity. When the algorithm shown in the FIG. 10 detects the pre-printed portion of one paper sheet, the algorithm might misjudge it as the overlapped paper sheets.

To solve the above misjudgement, the algorithm shown in the FIG. 10 can be modified to perform the detecting operation N times per one paper sheet. That is, the detecting operation is made by the MPU 9 or a control device at N portions of one paper sheet, such as a leading edge portion, a middle portion and a trailing portion. The MPU 9 stores the results of the detection at the three portions of the single paper sheet, and judges it to be a single paper sheet feed if one result indicates the single paper sheet feed. Such results are generated when the single paper sheet with a wide pre-printed black portion at the leading edge, a white blank portion at the middle portion and a wide pre-printed black portion at the trailing portion is fed into the paper sheet feed path.

Although the range of resistance change is divided to the 16 sections in the embodiment of the present invention, the range can be divided into more sections, such as 32, 64, 128, 256 sections.

Although the example of the R-$V_0$ characteristic curve wherein the detected voltage $V_0$ is decreased as the resistance value of the load resistor 4 is increased is shown in the embodiment of the present invention, a characteristic curve wherein the detected voltage $V_0$ is increased as the resistance value is increased could be used.

The invention reliably detects the overlapped paper sheet feed or multi-sheet feed by performing the calibration operation in response to one of the print start signal, the signal indicating that the number of paper sheet has reached the predetermined number, the signal indicating the switch of paper cassette and the error signal indicating the overlapped paper sheet feed, to calibrate or compensate the shift of the R-$V_0$ curves due to the variation of the operational characteristic of the LED, the photo transistor and the load resistor.

As a result, the invention remarkably improves the reliability of the paper sheet feed operation since the invention can detect the various overlapped paper sheet feeds, that is, (a) one paper sheet is fed in the first paper sheet feed and the overlapped paper sheets are fed in the succeeding paper sheet feed, (b) the overlapped paper sheets are discriminated as a single paper sheet in the first paper sheet feed and one paper sheet is fed in the succeeding paper sheet feed, and (c) the overlapped paper sheets are fed in the first paper sheet feed and discriminated as the overlapped paper sheets.

We claim:

1. A method for detecting overlapped paper sheet feed by discriminating a voltage detected by a photo sensor located in a paper sheet feed path, which represents a light transmittivity of paper sheet(s), comprising the steps of:

feeding a first paper sheet through said paper sheet feed path;

changing a sensitivity of said photo sensor between a first value generating a predetermined detected voltage at a feed of a single paper sheet of the highest light transmittivity and a second value generating said predetermined detected voltage at a feed of a single paper sheet of the lowest light transmittivity to determine whether said detected voltage becomes equal to said predetermined detected voltage;

fixing said sensitivity of said photo sensor to a value at which said detected voltage becomes equal to said predetermined detected voltage;

generating an error signal indicating the overlapped paper sheet feed when said detected voltage does not become equal to said predetermined detected voltage; and comparing said detected voltage of succeeding paper sheet(s) with a first threshold voltage which is established separately from said predetermined detected voltage for discriminating the single paper sheet feed and the overlapped paper sheet feed to generate an error signal when said detected voltage of said succeeding paper sheet is a voltage indicating the overlapped paper sheet feed.

2. A method for detecting overlapped paper sheet feed according to claim 1, wherein said photo sensor includes a photo transistor and a load resistor; said sensitivity of said photo sensor is changed by changing a resistance value of said load resistor between a first resistance value generating said predetermined detected voltage at a feed of single paper sheet of the highest light transmittivity and a second resistance value generating said predetermined detected voltage at a feed of single paper sheet of the lowest light transmittivity and said resistance value of said load resistor is fixed to a resistance value at which said detected voltage becomes equal to said predetermined detected voltage.

3. A method for detecting overlapped paper sheet feed according to claim 2, wherein said method includes steps of;

comparing a detected voltage of succeeding paper sheet(s) with a second threshold voltage which is established between said predetermined detected voltage and a voltage generated when the single paper sheet of said highest light transmittivity is fed through said paper sheet feed path in the case that said resistance value of said load resistor is not equal to said first resistance value within the range defined by said first and second resistance values; and generating an error signal indicating the overlapped paper sheet feed in previous paper sheet feed when said detected voltage is a voltage representing the single paper sheet feed.

4. A method for detecting overlapped paper sheet feed according to claim 2, wherein said step of changing said resistance value of said load resistor is initiated in response to one of a print start signal, a signal indicating that the number of paper sheets fed into said paper sheet path reaches a predetermined number, a switch signal for switching between the paper sheet feed of the highest light transmittivity and the paper sheet feed of the lowest light transmittivity, and said error signal.

5. Apparatus for detecting overlapped paper sheet feed in a paper sheet feed path comprising:

a photo sensor and a load resistor located in said paper sheet feed path for detecting a voltage representing a light transmittivity of paper sheet(s) fed through said paper sheet feed path;

a resistor control means for changing a resistance value of said load resistor between a first resistance value generating a predetermined detected voltage at a feed of single paper sheet of the highest light transmittivity and a second resistance value generating said predetermined detected voltage at a feed of single paper sheet of the lowest light transmittivity to compare a detected voltage of a first paper sheet with said predetermined detected voltage so as to generate a first signal indicating that said detected voltage becomes equal to said predetermined detected voltage and a second signal indicating that said detected voltage does not become equal to said predetermined detected voltage, fixing said resistance value of said load resistor in response to said first signal, and generating an error signal representing the overlapped paper sheet feed in said first paper sheet feed in response to said second signal; and first compare means for comparing a detected voltage of a second paper sheet with a first threshold voltage which is established separately from said predetermined detected voltage to discriminate the single paper sheet feed and the overlapped paper sheet feed so as to generate an error signal when said detected voltage of said second paper sheet is a voltage indicating the overlapped paper sheet feed.

6. Apparatus for detecting overlapped paper sheet feed in a paper sheet feed path according to claim 5, wherein said apparatus includes second compare means for comparing a detected voltage with a second threshold voltage which is established between said predetermined detected voltage and a voltage generated when the single paper sheet of said highest light transmittivity is fed through said paper sheet feed path in the case that said resistance value of said load resistor is not equal to said first resistance value within the range defined by said first and second resistance values, and generating an error signal indicating the overlapped paper sheet feed in previous paper sheet feed when said detected voltage is a voltage indicating the single paper sheet feed.

7. Apparatus for detecting overlapped paper sheet feed in accordance with claim 5, wherein said resistor control means comprises:

a counter connected to said load resistor for controlling said resistance value of said load resistor; and means for incrementing said counter in response to a signal indicating an existence of said paper sheet in said paper sheet feed path, and stopping the increment of said counter in response to said first signal.

* * * * *